US009328912B2

(12) United States Patent
Del Rosario

(10) Patent No.: US 9,328,912 B2
(45) Date of Patent: May 3, 2016

(54) ILLUMINATING BAR OF SOAP

(71) Applicant: Lee Del Rosario, Glendale, CA (US)

(72) Inventor: Lee Del Rosario, Glendale, CA (US)

(73) Assignee: Vida Luminations, Inc., Glendale, CA (US)

( * ) Notice: Subject to any disclaimer, the term of this patent is extended or adjusted under 35 U.S.C. 154(b) by 0 days.

(21) Appl. No.: 14/573,421

(22) Filed: Dec. 17, 2014

(65) Prior Publication Data

US 2015/0253001 A1 Sep. 10, 2015

Related U.S. Application Data

(63) Continuation-in-part of application No. 14/323,815, filed on Jul. 3, 2014, now abandoned.

(60) Provisional application No. 61/928,272, filed on Jan. 16, 2014.

(51) Int. Cl.

| | |
|---|---|
| ***F21V 33/00*** | (2006.01) |
| ***C11D 17/00*** | (2006.01) |
| ***C11D 17/04*** | (2006.01) |
| *F21Y 101/02* | (2006.01) |

(52) U.S. Cl.

CPC ..... *F21V 33/004* (2013.01); *C11D 17/0047* (2013.01); *C11D 17/0095* (2013.01); *C11D 17/048* (2013.01); *F21Y 2101/02* (2013.01)

(58) Field of Classification Search

None

See application file for complete search history.

(56) References Cited

U.S. PATENT DOCUMENTS

2015/0005224 A1* 1/2015 Traynor ..... 510/447

* cited by examiner

*Primary Examiner* — Necholus Ogden, Jr.

(74) *Attorney, Agent, or Firm* — Buchalter Nemer

(57) ABSTRACT

An illuminating bar of soap is disclosed that includes a shell, a light module, and a soap dispenser; wherein the light module comprises a sensor and at least one light source; whereas when the sensor senses a change in its surroundings, stability or a combination thereof, such as motion, temperature or light, the sensor triggers the light source to illuminate for a predetermined amount of time.

14 Claims, 8 Drawing Sheets

ILLUMINATING BAR OF SOAP

This United States Continuation in Part Application claims priority from U.S. Utility application Ser. No. 14/323,815 filed on Jul. 3, 2014, which claims the benefit of priority based on Provisional Application Ser. No. 61/928,272 filed on Jan. 16, 2014 and entitled "A motion activated, timed, led illuminated soap bar, designed to teach people of all ages how to wash and sanitize hands", which are commonly-owned and incorporated in their entirety by reference.

FIELD OF THE SUBJECT MATTER

The field of the subject matter relates to soap, in particular, a bar of soap that illuminates. The bar of soap senses a change in its surroundings, stability or a combination thereof, such as motion, temperature or light and illuminates for a predetermined length of time depending on the change.

BACKGROUND

Washing hands properly, especially for children, can be challenging. Individuals, especially children, do not like to wash their hands. Others need to be reminded to wash their hands. Others need to be taught how to wash their hands properly. The lack of proper hand washing often leads to the spread of germs which leads to contamination throughout households, schools, restaurants, hospitals and other public places.

Most individuals are unaware of how to properly wash their hands and fewer know the proper length to do so. According to the Centers for Disease Control and Prevention and US Food and Drug Administration, it is suggested the proper length of time needed to wash hands in avoiding the spread of possible sicknesses is 20 to 30 seconds with soap and warm water. Having a device that makes washing hands interesting and educational would help lessen the spread of germs and effectively avoid the spread of sicknesses and viruses.

Humans are attracted to light and color. Therefore, it would be ideal to provide individuals with visual cues and a visual incentive to engage them (especially children) with the process of washing their hands.

SUMMARY

An illuminating bar of soap comprising a shell, a light module and a soap dispenser.

An illuminating bar of soap comprising a shell, a plug and a soap dispenser, wherein the plug contains a light module; wherein the light module comprises a sensor, a circuit board, and at least a single light source; and wherein when the sensor senses a change in surrounding, the sensor triggers the at least one light source to illuminate for a predetermined amount of time.

A method of washing hands using an illuminating bar of soap, wherein the illuminating bar of soap comprises a shell, a light module, a soap dispenser; wherein the light module comprises a sensor and at least one light source, the method comprising compressing the shell to release a liquid soap; triggering the sensor causing the at least one light source to illuminate; illuminating the at least one light source; and washing the user's hands with the illuminating bar of soap, wherein the at least one light source stops illuminating when the user should stop washing the user's hands.

BRIEF DESCRIPTION OF THE FIGURES

By way of example only, selected embodiments and aspects of a contemplated embodiment are described below.

Each such description refers to a particular figure ("FIG.") which shows the described matter. Each such figure includes one or more reference numbers that identify one or more part(s) or element(s) of the contemplated embodiment.

DETAILED DESCRIPTION

Figure 1:
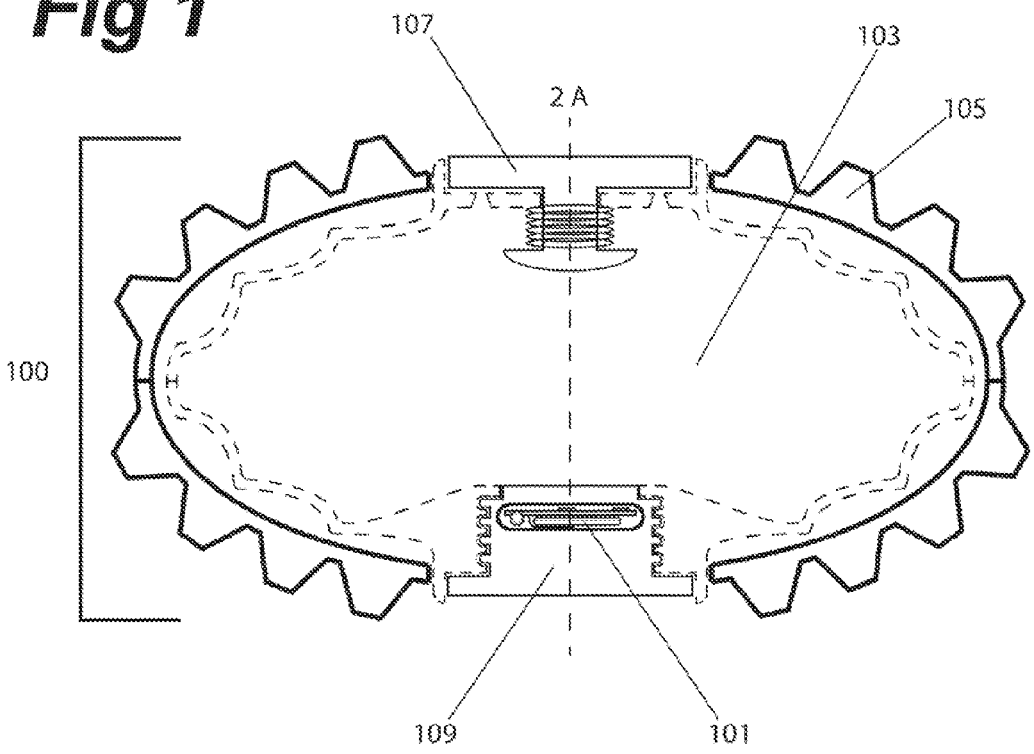
FIG. 1 shows a cross section of the contemplated embodiment of the illuminating bar of soap.

FIG. 1 shows a cross-section of a contemplated embodiment of the illuminating bar of soap 100 with the light module 101 inside it.

As shown in FIG. 1, the illuminating bar of soap 100, comprises a shell 105, a soap dispenser 107 and a light module 101. The light module 101 is placed within a plug 109.

The shell 105 may be manufactured from commonly used materials such as plastic, silicon, polyvinyl chloride, rubber and the like. Other materials such as UV reactive pigments may be added to create phosphorescence to the shell 105. The shell 105 may be comprised of a single layer or multiple layers. The shell may have a smooth first layer and then a detailed second layer. The shell 105, while shown as a single layer with ridges and indentations in the contemplated embodiment, may be manufactured smooth, with bumps, with lines or other designs. The shell 105 contains a cavity 103 for soap. The cavity 103 may be used to hold liquid soap or other similar cleaning solutions. The plug 109 may be manufactured from commonly used materials such as plastic, silicon, polyvinyl chloride, rubber and the like.

Figure 2:
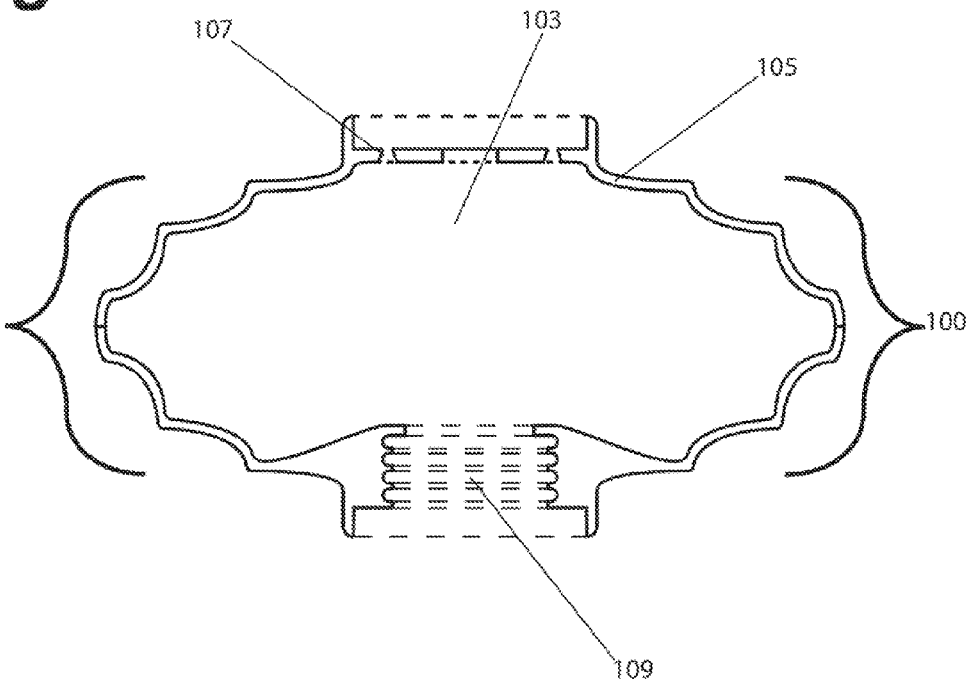
FIG. 2 shows a cross section through line 2A of the contemplated embodiment of the illuminating bar of soap.

FIG. 2 shows a cross section through line 2A of the contemplated embodiment of the illuminating bar of soap 100.

Figure 3:
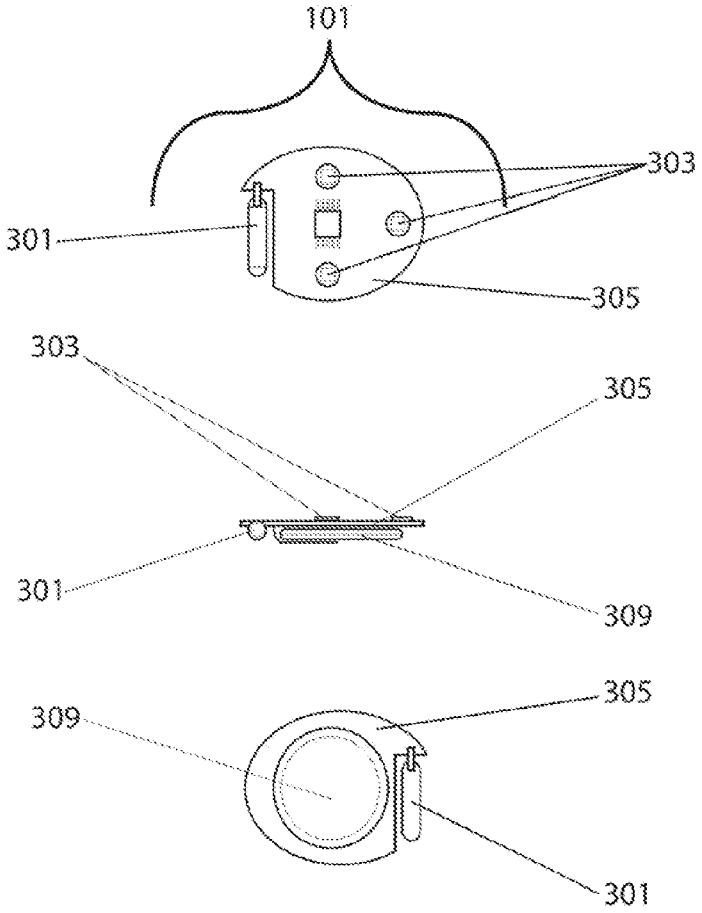
FIG. 3 shows a contemplated embodiment of the light module.

As shown in FIG. 3, the light module 101 comprises a sensor 301 and a light source 303. The sensor 301 and light source 303 may be constructed on a circuit board 305, it may be constructed on a circuit board with a processing unit, or be directly wired together. The sensor 301 is designed to detect a change in surroundings, a change in stability or a combination thereof and may be a motion sensor, a temperature sensor, a light sensor or any other sensor that monitors changes in surroundings. The sensor 301 triggers the light source 303.

The sensor 301, upon sensing a change in a change in surroundings, a change in stability or a combination thereof, triggers the light source 303 to illuminate. Should the sensor 301 be a motion sensor, upon detecting motion, the sensor triggers the light source 303 to illuminate for a predetermined length of time, usually approximately 20-30 seconds. The motion sensor may be any commonly used motion sensor such as a vibration sensor or reed switch. The light illuminates and stays illuminated for the time when the user should be lathering and rubbing their hands on the soap in order to wash their hands, often times, 20-30 seconds. When the light stops illuminating, it indicates that the user has properly washed their hands.

Should the sensor 301 be a temperature sensor, it may illuminate the light source 303 when the proper temperature for washing hands is met. Should the illumination occur at the proper temperature, the light source 303 will illuminate so long as the predetermined temperature is met. Also, it may illuminate for a predetermined length of time, so long as the predetermined temperature is met. Should the sensor 301 be a light sensor, it may illuminate the light source 303 when the sensor is exposed to light.

The light source 303 may be any commonly used light bulb including but not limited to a light emitting diode, organic light emitting diode, liquid crystal display or miniature incandescent bulb. The light source 303 may be comprised of a single light emitting diode or bulb or a plurality of them. The light source 303 may illuminate in a variety of colors, designs, patterns or shapes. The color, design, pattern or shape of the illumination may change depending on the variables from the sensor, i.e. the color may change if the temperature sensed is within a certain range. Also, the color, design, pattern or shape of the illumination may change depending on the amount of time the light source has illuminated 303 for.

The light module 101 has a battery 309 that powers it. The light module 101 is encapsulated by an inner housing 109 made of plastic, rubber or other material so that it is waterproof. The light module 101 may be encapsulated by a barrier 109 in any shape.

Figure 4:
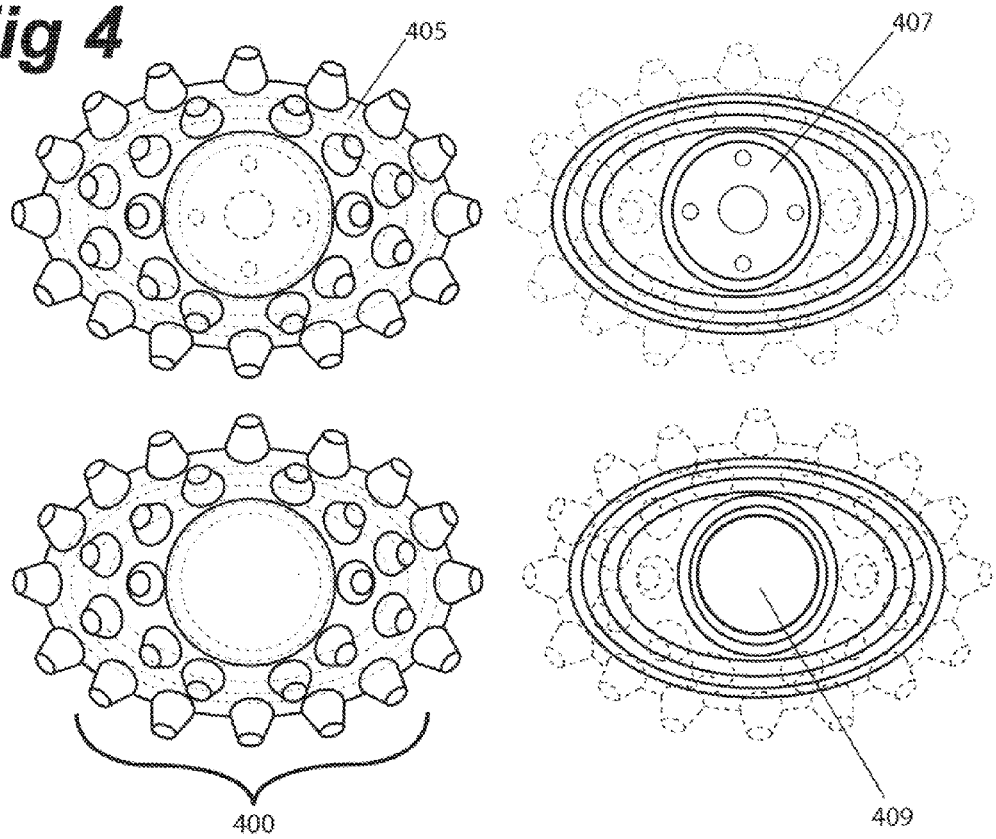
FIG. 4 shows a contemplated embodiment of the illuminating bar of soap.

FIG. 4 shows an alternative contemplated embodiment of the illuminating bar of soap 400. The shell 405 has a plug 409 and soap dispenser 407. A liquid soap is poured into the cavity 403 and is dispensed through the soap dispenser 407.

Figure 5:
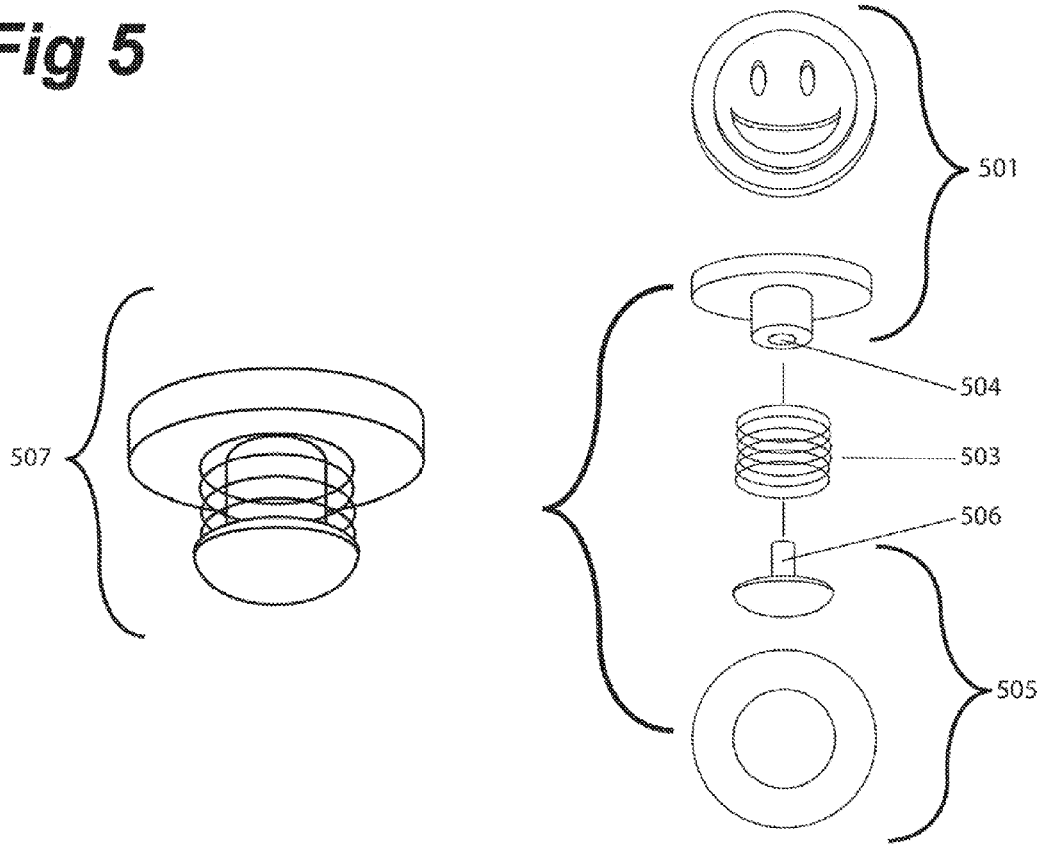
FIG. 5 shows a contemplated embodiment of the soap dispensing module.

FIG. 5 shows a contemplated embodiment of a soap dispenser 507. The soap dispenser 507 comprises a top button 501, a spring 503 and a bottom 505. The top button 501 contains a cylinder with a female portion 504 which accepts the protruding male portion 506 of the bottom 505. The soap dispenser when depressed compresses and releases the liquid soap. Another contemplated embodiment of a soap dispenser is a cartridge in which a top button has a protruding member that faces towards the cartridge. As the top button is depressed, it penetrates the cartridge in order to expel the soap from the cartridge. Other embodiments of dispensing liquids may be used for the soap dispenser.

Figure 6:
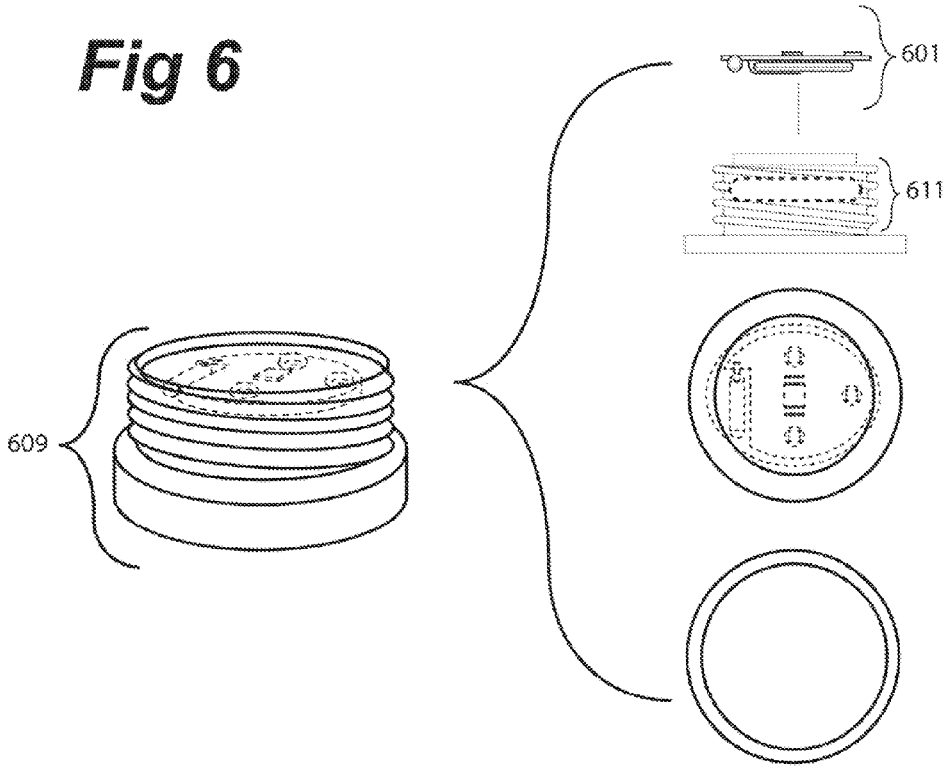
FIG. 6 shows a contemplated embodiment of the plug.

FIG. 6 shows a contemplated embodiment of a plug 609. The plug 609 contains a light module 601 built-in, embedded, molded, placed or located within it. The plug 609 is threaded 611 so that it may be screwed on or off of the illuminated bar of soap. The plug 609 allows soap to be poured in the cavity of the illuminated bar of soap. It plug 609 may also allow the user to change the battery in the light module 601.

Figure 7:
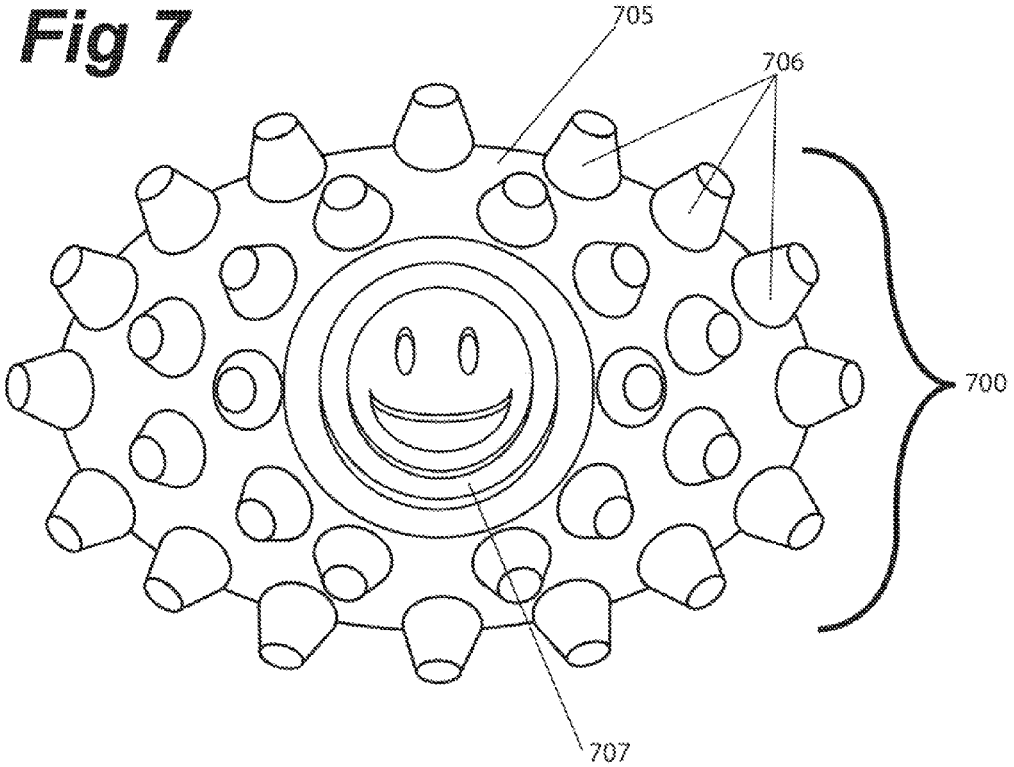
FIG. 7 shows a contemplated embodiment of the illuminating bar of soap.

FIG. 7 shows a top view of a contemplated embodiment of the illuminating bar of soap 700. The shell has a first smooth layer 705 which has an additional layer of protruding spikes 706. The soap dispenser 707 is also shown.

Figure 8:
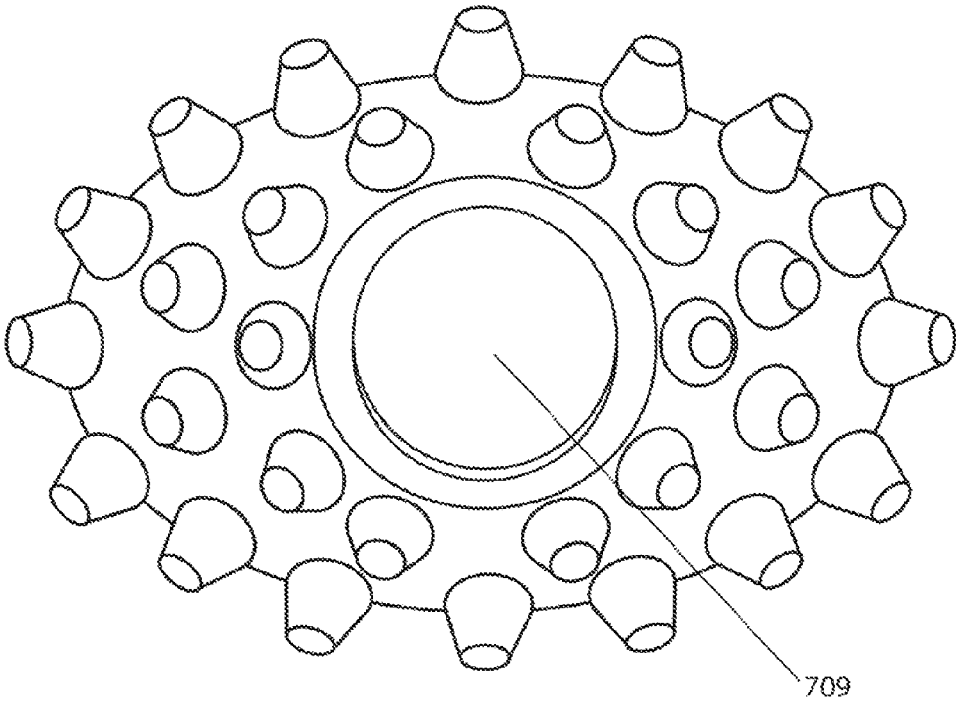
FIG. 8 shows the bottom side of the contemplated embodiment of the illuminating bar of soap in FIG. 7.

FIG. 8 is the same contemplated embodiment of FIG. 7, but the bottom view. The plug 709 is shown.

Thus, specific embodiments of an illuminated soap bar have been disclosed. It should be apparent, however, to those skilled in the art that many more modifications besides those already described are possible without departing from the inventive concepts herein. The inventive subject matter, therefore, is not to be restricted except in the spirit of disclosure herein. Moreover, in interpreting the specifications and claims, all terms should be interpreted in the broadest possible manner consistent with the context. In particular, the terms "comprises" and "comprising" should be interpreted as referring to elements, components, or steps in a non-exclusive matter, indicating that the referenced elements, components, or steps may be present, or utilized, or combined with other elements, components, or steps that are not expressly referenced.

What is claimed is:

1. An illuminating bar of soap, comprising:

a shell including at least one layer defining a cavity, the shell having an opening;

a plug, removably coupled to the shell at the opening, configured to seal the opening;

a light module contained in the plug having at least one sensor and at least one light source triggered by the at least one sensor; and a soap dispenser coupled to the shell and configured to release a liquid soap contained in the shell when the shell is compressed.

2. The illuminating bar of soap of claim 1, wherein the at least one sensor is a motion sensor.

3. The illuminating bar of soap of claim 1, wherein the at least one sensor is a temperature sensor.

4. The illuminating bar of soap of claim 1, wherein the at least one sensor is a light sensor.

5. The illuminating bar of soap of claim 1, wherein the at least one light source is at least one light emitting diode powered by at least one battery.

6. The illuminating bar of soap of claim 1, wherein the at least one light source illuminates for a predetermined length of time.

7. An illuminating bar of soap, comprising:

a shell including at least one layer defining a cavity, the shell having an opening;

a plug coupled to the shell at the opening, the plug is removable from the shell;

a light module within the plug having at least one sensor and at least one light source, wherein the light module is configured to detect a change in a surrounding condition with the sensor and trigger the at least one light source to illuminate for a predetermined amount of time; and a soap dispenser coupled to the shell and configured to release a liquid soap contained in the shell when the shell is compressed.

8. The illuminating bar of soap of claim 7, wherein the sensor senses motion.

9. The illuminating bar of soap of claim 7, wherein the sensor senses a change in temperature.

10. The illuminating bar of soap of claim 7, wherein the sensor senses a change in light.

11. A method of washing hands using an illuminating bar of soap, wherein the illuminating bar of soap comprises a shell, a light module, and a soap dispenser;

a shell including at least one layer defining a cavity, the shell having an opening for a plug; the plug is removably coupled to the shell; a light module associated with the plug having at least one sensor and at least one light source triggered by the at least one sensor; a soap dispenser coupled to the shell and configured to release a liquid soap contained in the shell when the shell is compressed, the method comprising:

compressing the shell to release the liquid soap;

triggering the sensor causing the at least one light source to illuminate;

illuminating the at least one light source; and washing the hands with the illuminating bar of soap, wherein the at least one light source stops illuminating when the user is to stop washing the user's hands.

12. The method of claim 11, wherein the sensor is a motion sensor.

13. The method of claim 11, wherein the sensor triggers the at least one light source to illuminate for a predetermined length of time.

14. The method of claim 11, wherein the sensor is a temperature sensor.

* * * * *